United States Patent [19]

Doslik et al.

[11] Patent Number: 4,848,190

[45] Date of Patent: Jul. 18, 1989

[54] APPARATUS FOR THE AUTOMATIC MANUFACTURE OF A PUNCH HAVING A SHARP CUTTING EDGE

[75] Inventors: Peter Doslik, Stuttgart; Werner Sommer, Esslingen, both of Fed. Rep. of Germany

[73] Assignee: Kocher & Beck OHG Gravieranstalt und Rotationsstanzenbau, Leinfelden-Echterdingen, Fed. Rep. of Germany

[21] Appl. No.: 127,241

[22] Filed: Dec. 1, 1987

[51] Int. Cl.[4] ..... B21K 5/20

[52] U.S. Cl. ..... 76/4; 72/325; 72/412; 76/107 C; 76/89.2

[58] Field of Search ..... 76/4, 107 R, 107 C, 76/89.2; 72/412, 325, 71, 76; 10/153, 21, 9, 24

[56] References Cited

U.S. PATENT DOCUMENTS

| | | | |
|---|---|---|---|
| 1,113,900 | 10/1914 | Jackson | 72/76 |
| 2,467,302 | 4/1949 | Forster et al. | 76/89.2 |
| 3,696,480 | 10/1972 | Sauer et al. | 76/107 C |
| 3,905,283 | 9/1975 | Baker | 76/107 R |
| 4,528,836 | 7/1985 | Durand-Texte | 72/412 |
| 4,579,022 | 4/1986 | Kasai et al. | 72/325 |

*Primary Examiner*—Roscoe V. Parker

[57] ABSTRACT

The invention relates to an apparatus for the automatic production of a punch having a sharp cutting edge, especially for label cutting apparatus, made from a punch body provided with an upstanding land. To avoid the former manual finishing of the land produced by etching or by some other manner, a largely automatically operating apparatus is proposed which has a table (6) for the punch body, a tool (56) with a roof-shaped notch facing the table (6), a first drive (64) for the automatic movement of the tool (56) back and forth in the direction of the table (6) and additional drive (15, 37, 51, 62) for the production of relative movements between the table (6) and the tool (56), by means of which the tool (56) can be guided automatically along the land (22) (FIG. 1).

20 Claims, 12 Drawing Sheets

APPARATUS FOR THE AUTOMATIC MANUFACTURE OF A PUNCH HAVING A SHARP CUTTING EDGE

Figure 1:
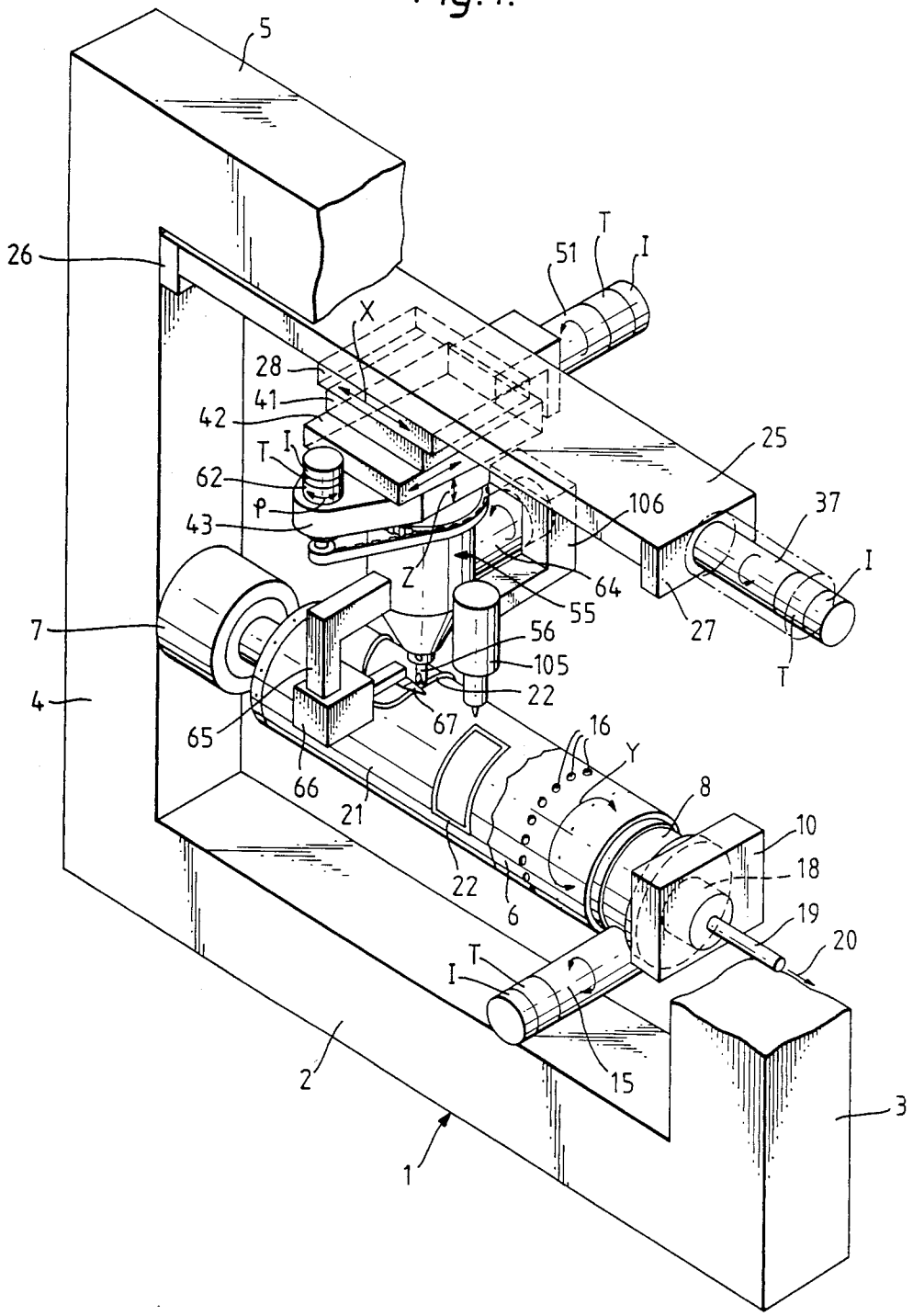

The invention relates to an apparatus for the automatic production of a punch which has a sharp cutting edge and which consists of a punch body provided with an upstanding land, especially for use in label cutting apparatus for paper, metal foils or plastic films, textiles, flexible printed circuits, labels or the like.

For cutting through soft materials, such as papers, plastic films, textiles, flexible circuit boards, labels or the like, punching devices are mostly used which have punches with sharp cutting edges. The punches can consist, for example, of platens, cylinders, or flexible plates held on cylinders, the cutting edges of which project in the form of sharpened, upstanding ridges.

These cutting edges should have a uniform height over the entire punch. In the manufacture and further processing of pressure-sensitive or gummed labels, for example, the starting material consists of a label paper provided with an adhesive coating. The purpose of the punch is to act on the starting material such that the label paper will be completely cut through according to the desired outline of the labels, but the backing strip will remain virtually uncut. If this requirement is not satisfied trouble will be encountered in the automatic production of the labels whenever the "lattice" surrounding the labels is removed from the backing strip or when, during the further handling of the labels in an automated production apparatus, such as a packaging machine or an envelope addressing and labeling machine, the labels themselves are pulled from the backing strip to be applied to an object. If the label paper has not been cut through cleanly all around in the punching process, the "lattice" pulls the labels with it, resulting in a nuisance and in some cases a long shut-down of the entire production system. Similar disadvantages result when not only the label paper but also the backing is wholly or partially cut through, since in this case the labels cannot be released correctly without pulling pieces of the backing with them. Since the label paper often has a thickness of only 0.1 mm and the backing a thickness of only 0.05 mm, the height of the cutting edges of the punch must satisfy tolerances of several hundredths of a millimeter down to less than one hundredth of a millimeter. Such close tolerances are desired also when paper webs without a protective backing are involved and, for example, a window is to be punched into a mailing envelope so that the backing used in the punching process and consisting for example of rubber or steel will neither be destroyed nor cause the rapid dulling of the cutting edges.

It has been common practice heretofore to form the cutting edges for example by removing the areas surrounding them by erosion or etching and then providing the remaining lands with sufficiently sharp cutting edges by manual, mechanical treatment, because with the etching methods known heretofore neither the desired thin cutting edges of about 0.01 mm and less nor the necessarily close height tolerances can be guaranteed. The method consists mostly in scraping the raised edges with a sharp edge of an engraving burin or the like, manually, from at least one side under a magnifying glass, which not only is a time-consuming, tiring activity and calls for well-trained workers, but also easily leads to flaws which can result in the rejection of an entire punch. Scraping the sides furthermore requires that the original punch body from which the punch is made be itself subject to close tolerances, so that only highquality materials may be used for this purpose. Overall, this results in slow deliveries of the punch bodies and/or in slow production of the punches.

The invention is addressed to the task of devising an apparatus by means of which the manual finishing of a raised edge produced by etching or otherwise on a punch can be performed largely automatically. The invention furthermore is to make it possible for the height tolerances in the production of the lands in the first step of the process to be less critical than heretofore, and to some extent to equalize variations in thickness of the punch bodies.

The invention is characterized by a table for the punch body, by a hammering and/or cutting tool with a roof-shaped notch facing the table, by a first drive means for the automatic back-and-forth movement of the tool in the direction of the table, and by additional drive means for producing relative movements between the table and the tool by means of which the tool can be guided automatically along the land.

The invention is based on the surprising discovery that a raised edge which is unusable for punching thin paper webs or plastic films can be provided with a very sharp cutting edge having a definite and constant height by a hammering process. Since the hammering can be performed automatically and at high frequency, the time required for producing the punches is considerably shorter than heretofore. It is furthermore advantageous that the hardening of the material that takes place in the transformation of the raised edge to a cutting edge makes it possible to use metals of lesser quality rather than the high-quality metals which have been used heretofore to achieve punches of longer useful life. Furthermore, the height tolerances of the cutting edge depend mostly on the tolerances in the hammering process, which can be kept very small, so that lesser demands can be placed on the punches, particularly in regard to their thickness tolerances, thereby shortening the time required for their production. Lastly, the advantage is achieved that the finishing of the lands is no longer a tiring, monotonous activity that can be performed only with great concentration, because the manual activity is reduced substantially to the advancement of the punch body during the hammering process and the inspection of the cutting edges produced.

Figure 2:
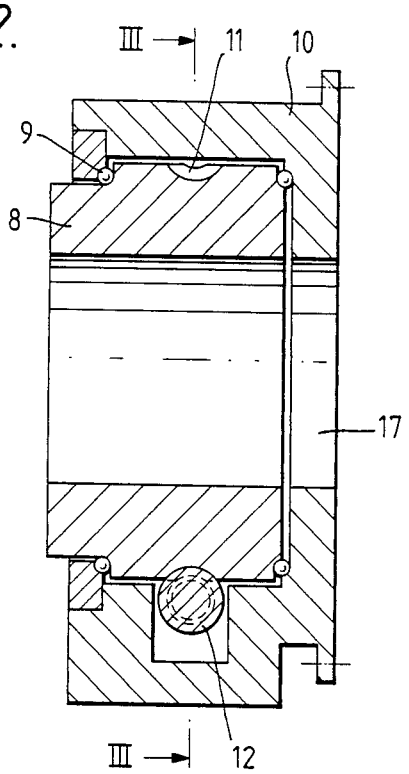
Figure 3:
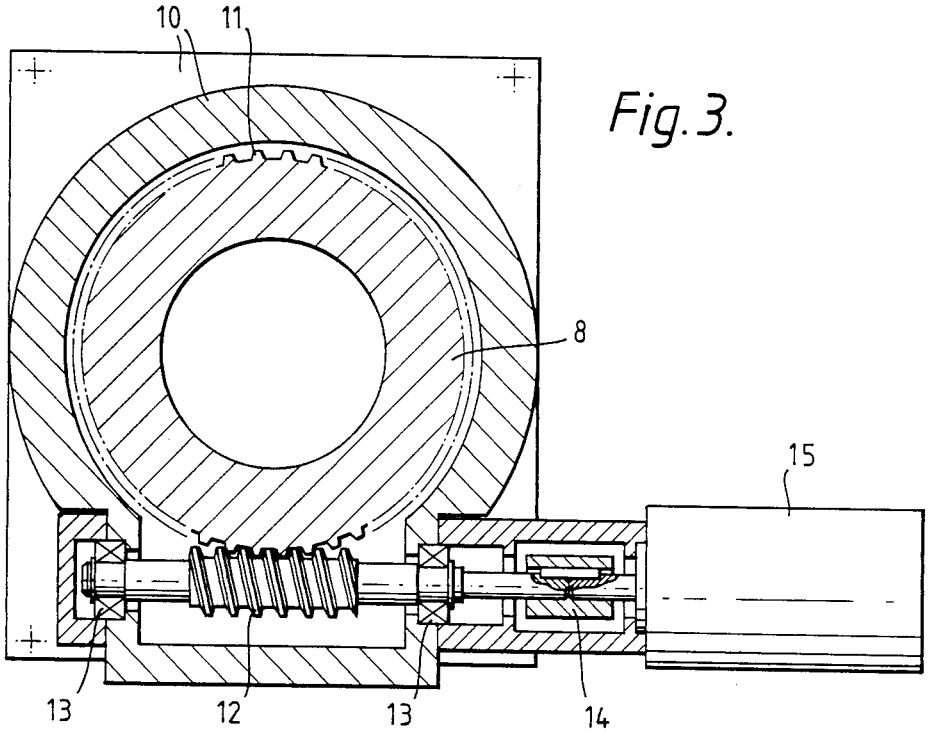
Figure 5:
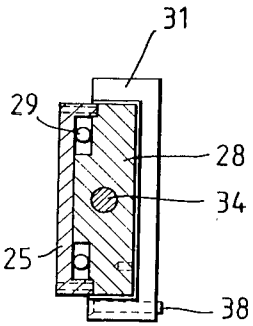
Figure 4:
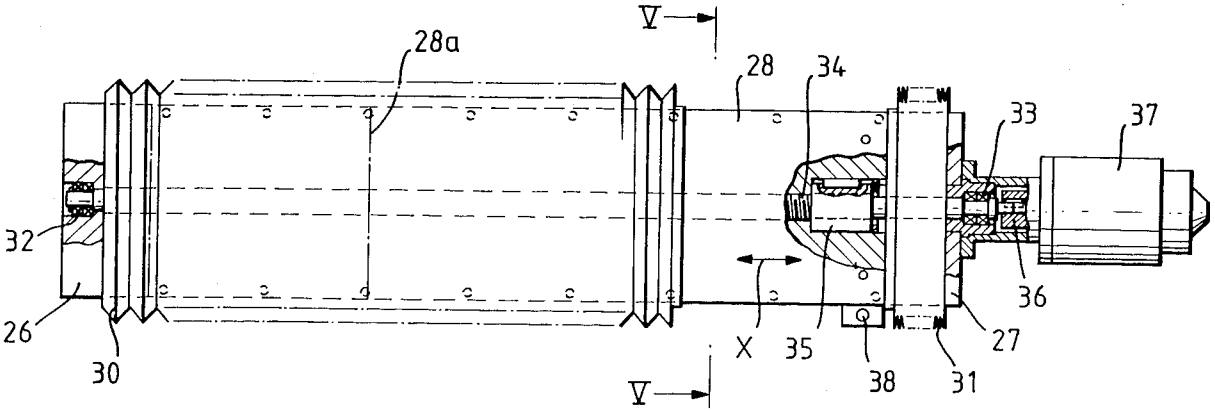
Figure 6:
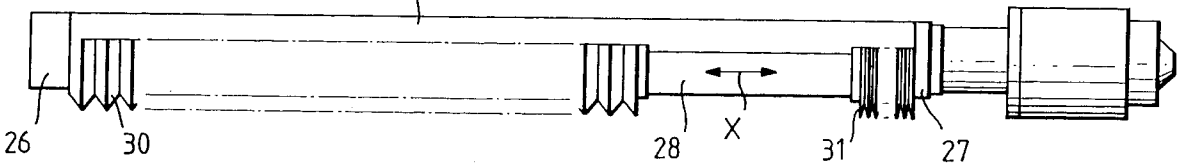
Figure 7:
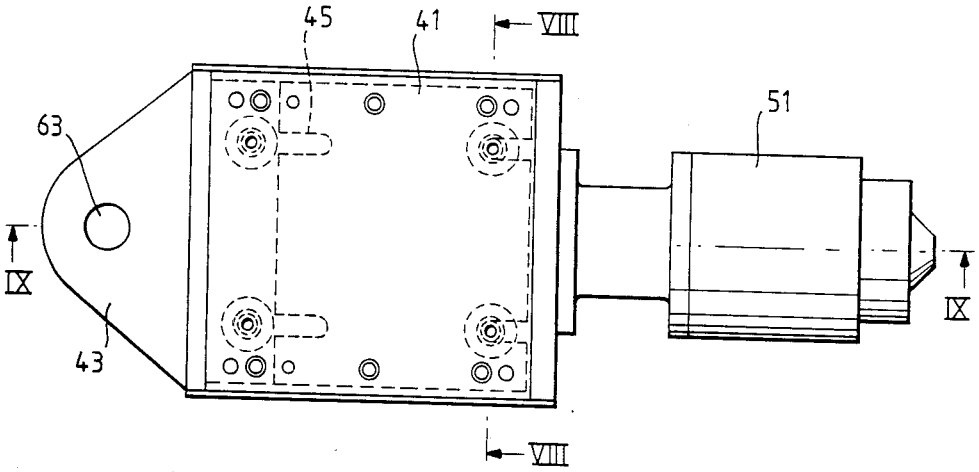
Figure 8:
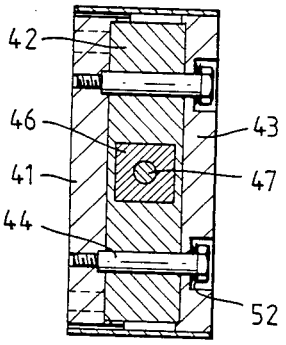
Figure 9:
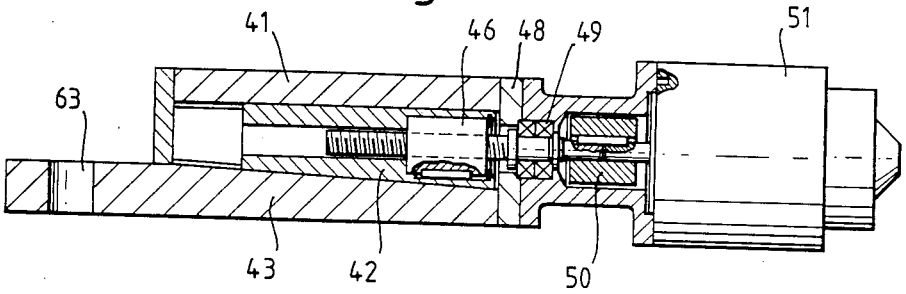
Figure 10:
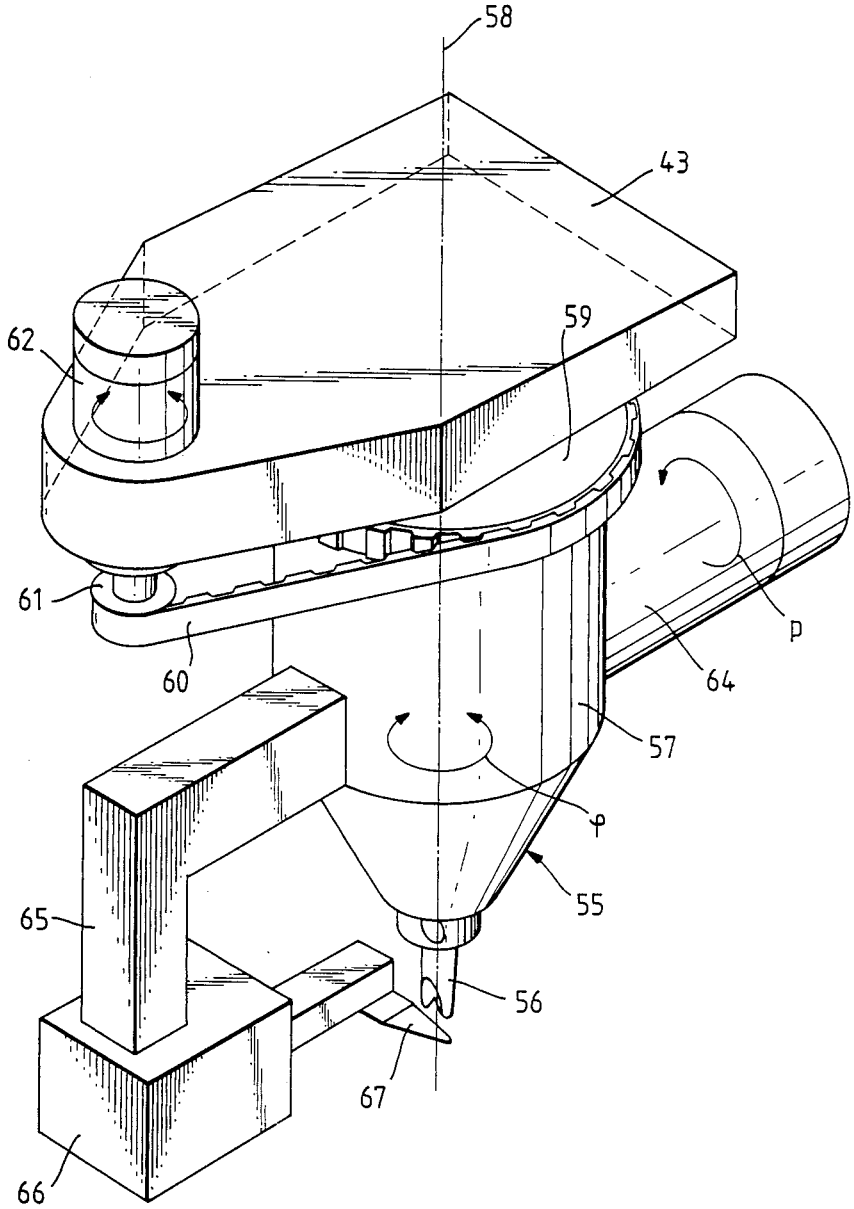
Figure 11:
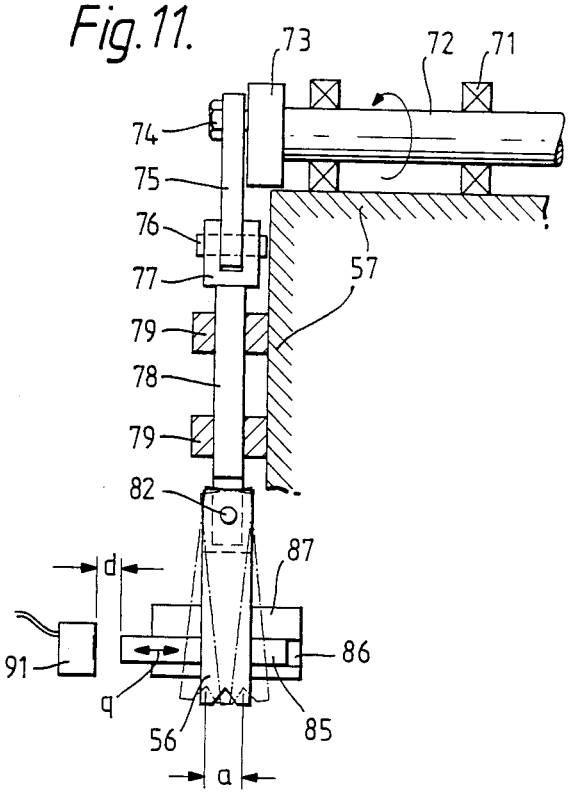
Figure 12:
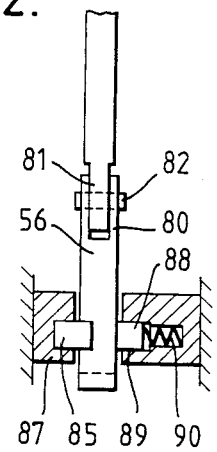
Figure 13:
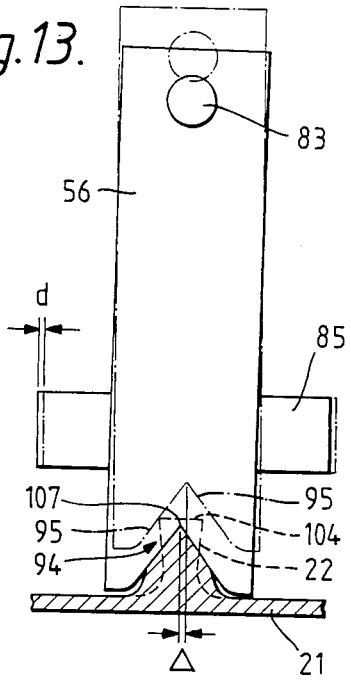
Figure 14:
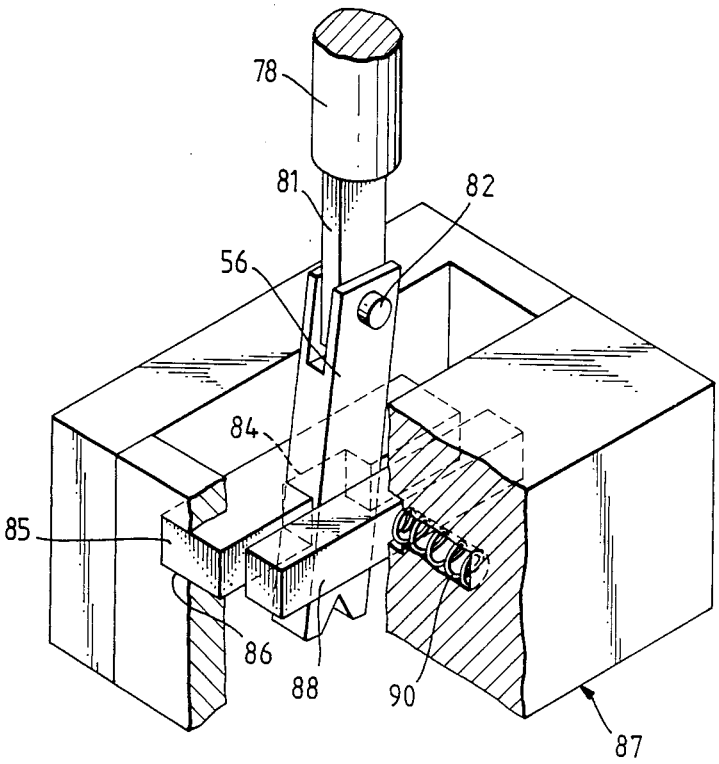
Figure 15:
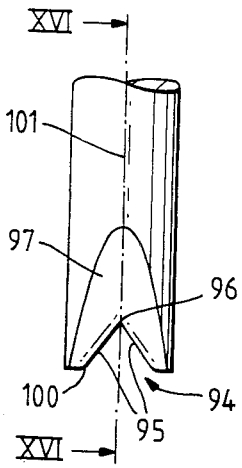
Figure 16:
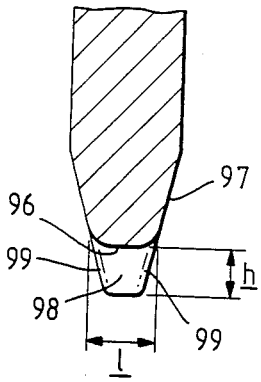
Figure 21:
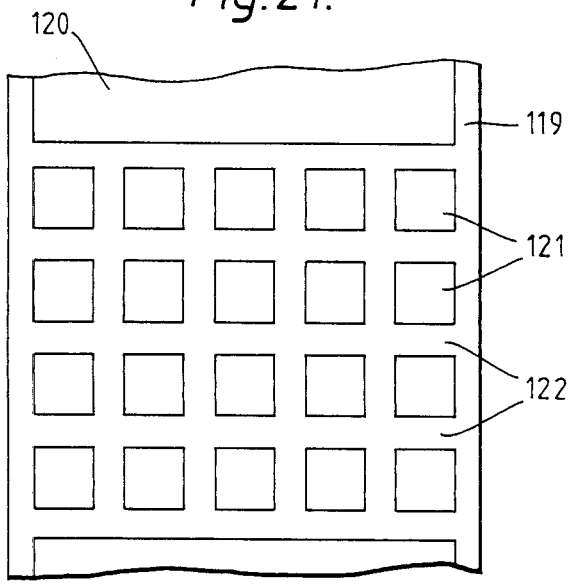
Figure 22:
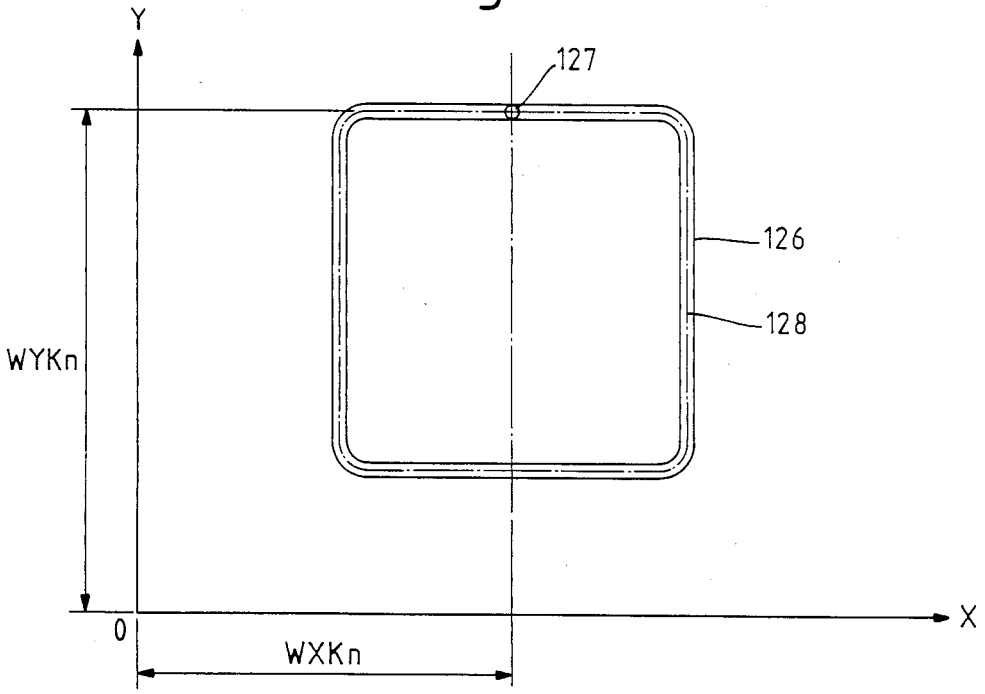
Figure 23:
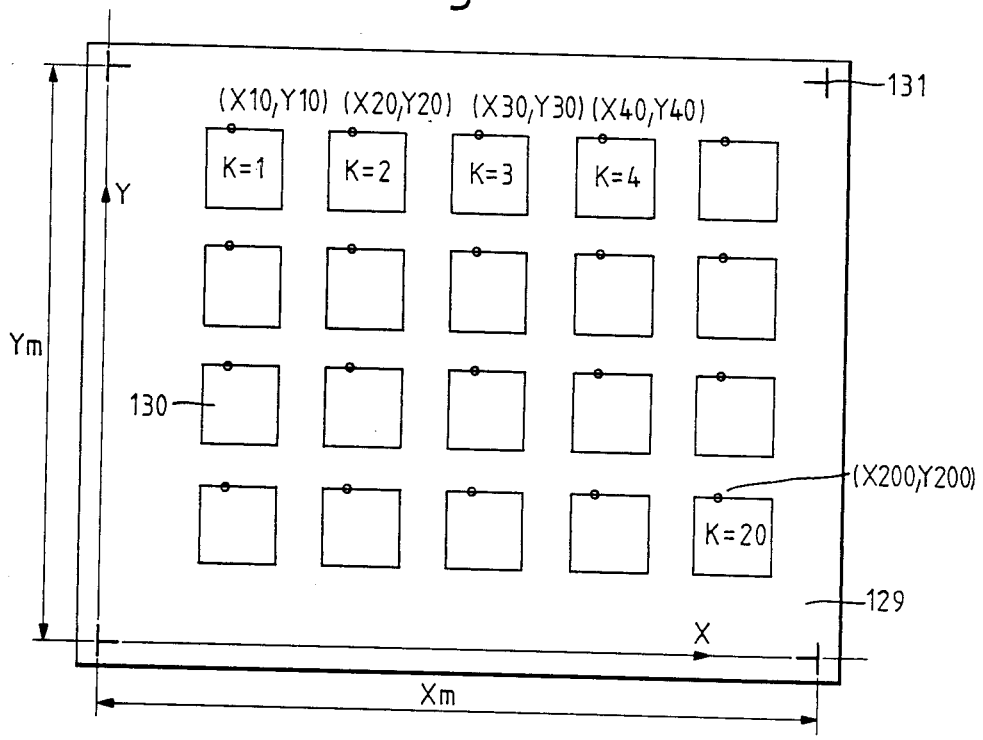
Figure 24:
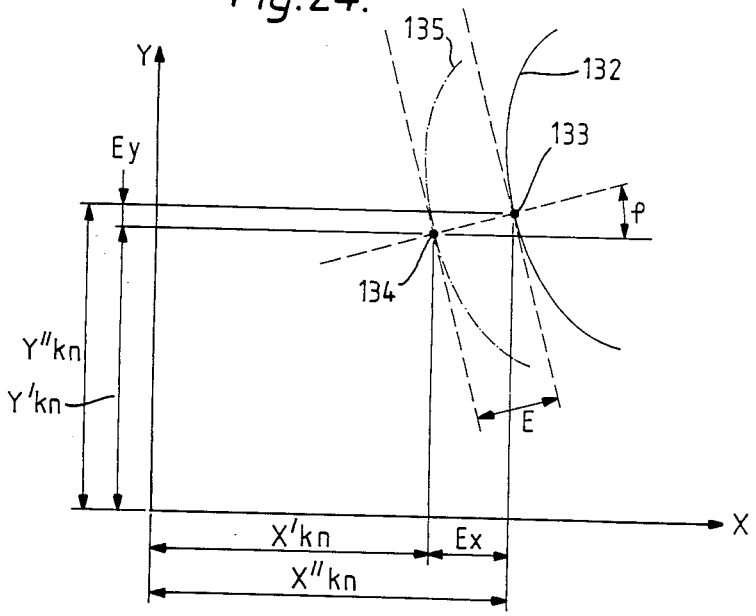
Figure 25:
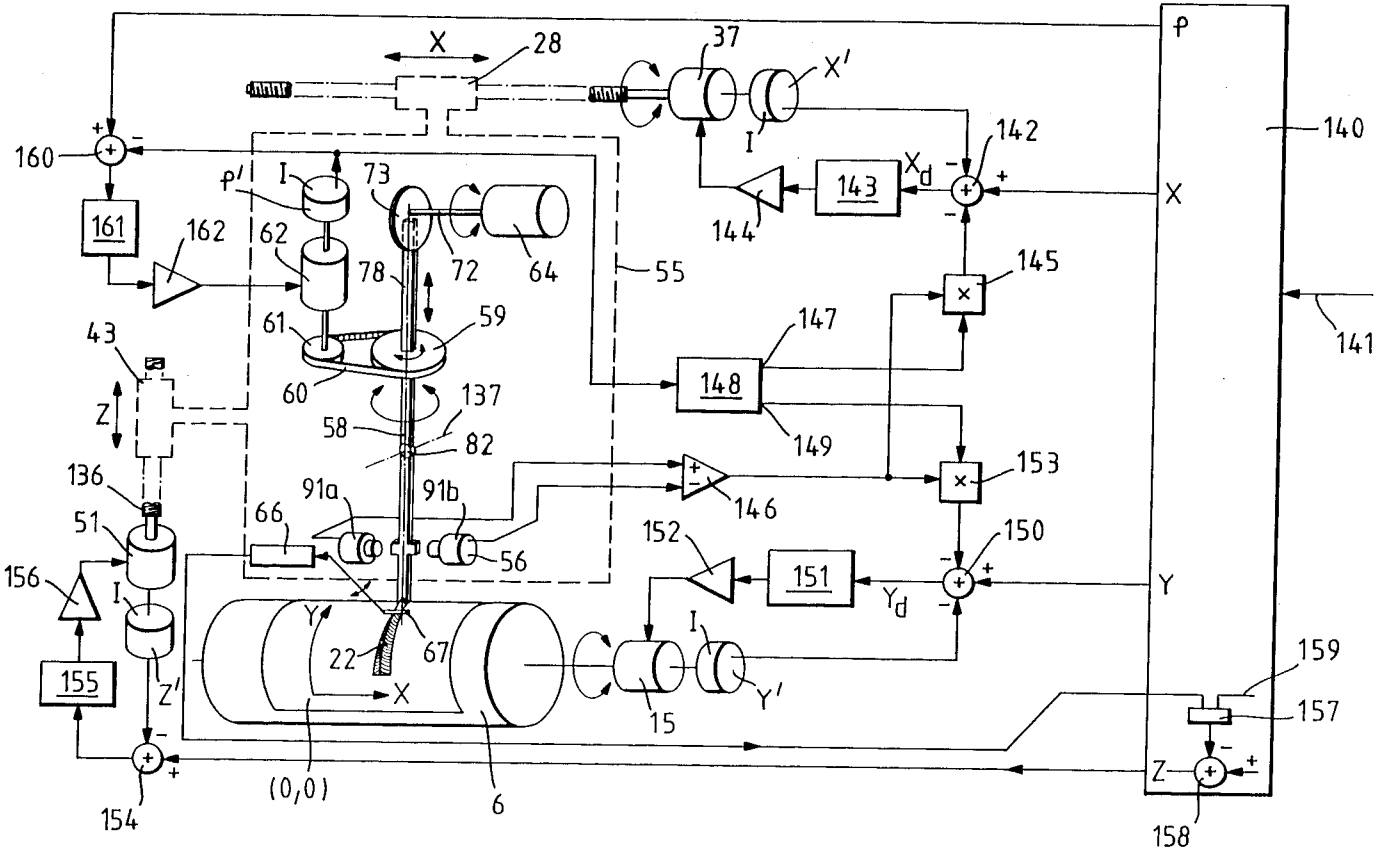
Figure 26:
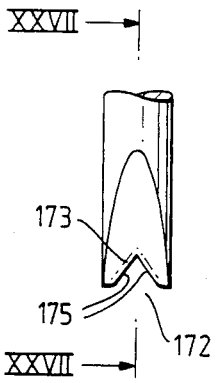
Figure 27:
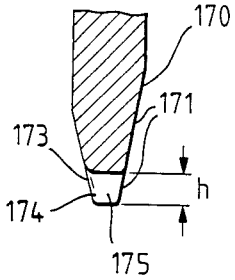
Figure 28:
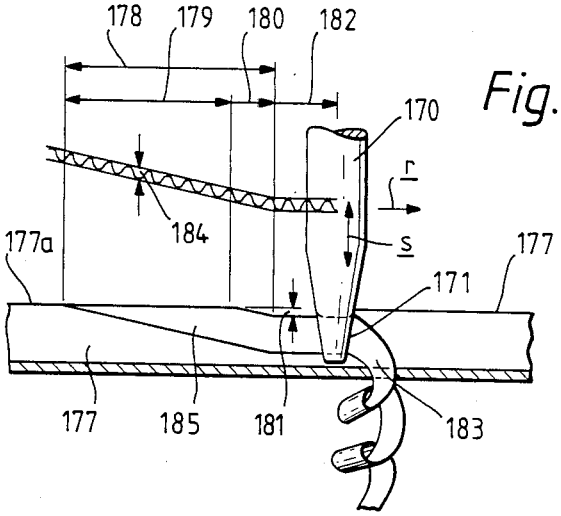
Figure 29:
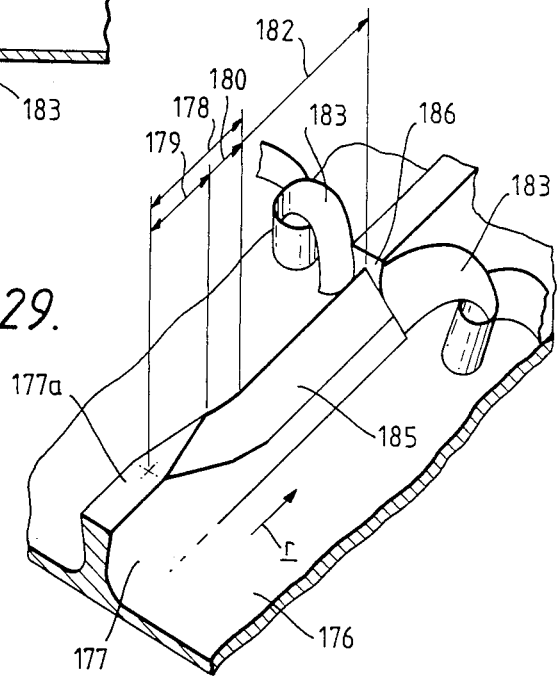

The invention will be further explained below by means of an embodiment in conjunction with the appended drawing, wherein FIG. 1 is a diagrammatic and perspective representation of the apparatus according to the invention for the automatic production of a punch having a sharp cutting edge, FIG. 2 is an enlarged longitudinal section through a drum bearing of the apparatus according to FIG. 1, FIG. 3 is a section along line III—III of FIG. 2, FIG. 4 is an enlarged view, partially cut away, of a cross table and a horizontal carriage of the apparatus of FIG. 1, as seen from below, FIG. 5 is a section along line V—V of FIG. 4, FIG. 6 is a front view of the cross table and of the horizontal carriage according to FIG. 4, FIG. 7 is an enlarged top view of a vertical carriage of the apparatus according to FIG. 1, FIG. 8 is a section along line VIII—VIII of FIG. 7, FIG. 9 is a section along line IX—IX of FIG. 7, FIG. 10 is a perspective, enlarged representation of a hammering mechanism of the apparatus according to FIG. 1, FIG. 11 is an enlarged view, partially in section, of a drive system for a hammering tool of the apparatus according to FIG. 1, FIG. 12 is a side view, partially in section, of the drive system according to FIG. 11, FIG. 13 is an enlarged front view of the hammering tool according to FIG. 11, FIG. 14 is an enlarged, perspective and partially cutaway representation of a guiding and braking system for the hammering tool according to FIGS. 11 and 13, FIG. 15 is a front view of a detail of the hammering tool according to FIG. 1, FIG. 16 is a section along line XVI—XVI of FIG. 15, FIG. 17 to 20 are diagrammatic representations, partially in section, of the transformation of a land to a sharp cutting edge by using the apparatus according to FIG. 1, FIG. 21 is a diagrammatic plan view of a sample of punched pressure-sensitive labels, FIG. 22 is an enlarged plan view of a design for the etched land of a punch body appropriate for punching out a single label according to FIG. 21, FIG. 23 is an enlarged plan view of a punch body provided with etched lands for the simultaneous punching of all of the labels of FIG. 21, FIG. 24 is a diagrammatic representation of the corrections necessary for the adjustment of the apparatus according to FIG. 1 to a starting position, FIG. 25 is a diagrammatic block circuit diagram of the apparatus according to FIG. 1 with the circuitry required for its control, FIGS. 26 and 27 are views corresponding to FIGS. 15 and 16 of a combined hammering and cutting tool, and FIGS. 28 and 29 are diagrammatic representations of the use of a tool according to FIGS. 26 and 27 for making a punch having a sharp cutting edge.

The apparatus according to FIG. 1 contains a rectangular frame 1 with a base plate 2, two side walls 3 and 4 and an upper cross member 5, the integral side wall and the likewise integral cross member 5 appearing only partially in FIG. 1. In the bottom part of the frame 1 a hollow cylindrical drum 6 with a horizontal axis is disposed, which is journaled at one end in a bearing 7 fastened to the side wall 4 and at its other end is fastened to a likewise hollow cylindrical ring gear 8. The ring gear 8 is journaled, as shown in FIGS. 1 to 3, on bearings 9 in a box 10 fastened to the side wall 3. The ring gear 8 is provided with external teeth 11 in the manner of a worm gear, which are engaged by a worm 12 which is journaled in bearings 13 in the box 10 and is connected by means of a coupling 14 to a drive, e.g., the coaxial drive shaft of a reversible Y-axis motor 15. With the motor 15 turned on, the drum 6 is turned in a first direction, e.g., in the direction of a double arrow Y designating, for example, the Y axis of an imaginary coordinate system.

The circumference of the drum 6 is provided with diagrammatically indicated bores 16 and the box 10 has a bore 17 in the prolongation of the cavity of the ring gear 8 (FIG. 2) to which a vacuum line 19 passing through the side wall 3 is connected through a seal 18 (FIG. 1). This vacuum line is connected to a vacuum pump, not shown, which when turned on draws air from the inner cavity of the drum 6 in the direction of an arrow 20 and thereby a vacuum is produced and air is aspirated through the bores 16. The vacuum serves to draw a punch body 21, in the form of a thin metal plate represented only partially in FIG. 1 and placed on the circumference of the drum 6, tightly against the drum circumference, and to hold it against displacement thereon, although other overlays and means for fastening the punch body 21 can be provided instead of the drum 6 and the bores 16. The surface of the punch body 21 is provided with at least one elevated land 22 which has been made, for example, by etching in a preceding process step, and which after the punch body 21 is been placed on the drum 6 is substantially perpendicular to its circumferential surface.

A cross table 25 with end plates 26 and 27 is affixed to the bottom end of the cross member 5 as shown in FIGS. 1 and 4 to 6, on whose horizontal bottom a component is movably mounted which consists for example of a horizontal slide 28 displaceably carried on rolling bearings 29. This slide is connected at each end to a bellows 30, 31, connected to the corresponding end plate 26, 27, and this bellows covers any exposed portion of the cross table 25. A bearing 32 is fastened in the end plate 26 and a bearing 33 in the end plate 27, and in them a threaded spindle 34 extending between the end plates 26 and 27 is journaled, which passes through a nut 35 fastened in the horizontal slide 28 and provided with a matching internal thread. A free end of the threaded spindle 34 extending through the side wall 27 is connected by means of a coupling 36 to an additional drive means, e.g., the drive shaft of a reversible X-axis motor 37 fastened to the end plate 27. When the motor 37 is turned on the threaded spindle 34 is rotated and therefore moves the horizontal slide 28 in a second direction, e.g., in the direction of a double arrow X relating to the X axis of the imaginary coordinate system. At least at one end of the horizontal slide there is provided a limit switch 38 which cooperates with corresponding stops, not shown, on the cross table 25 in order to shut off the motor 37 when the horizontal slide 28 reaches the end position, represented in solid lines in FIG. 4, close to the end plate 27, or an end position indicated in broken lines FIG. 4 and labeled 28*a*.

A holding plate 41 is fastened, with screws for example, to the bottom of the horizontal slide 28 as shown in FIGS. 1 and 7 to 9. On its bottom a wedge plate 42 is mounted with a sliding fit, and has, for example, a bottom surface disposed at an angle to the level bottom of the holding plate 41, this bottom surface resting on a likewise wedge-shaped surface, sloping in the same direction, of an additional movable component, e.g., a vertical slide 43. The vertical slide 43 is suspended by means of bolts 44 one of which is represented in FIG. 8. The bolts 44 pass through slots 45 (FIG. 7) formed in the wedge plate 42, so that the latter is displaceable between the holding plate 41 and the vertical slide 43.

A spindle nut 46 is fastened in an opening in the wedge plate 42, and into it is threaded a spindle 47 with a matching external thread. The free end of the spindle 47 passes through an end plate 48 fastened on the holding plate and is journaled in a bearing 49 connected with the latter. Furthermore, this end of the threaded spindle 47 is connected by a coupling 50 to an additional drive means, e.g., the output shaft of a reversible Z-axis motor 51 which is also fastened to the end plate 48. When the Z-axis motor 51 is turned on, the threaded spindle 47 begins to revolve. The result is that the spindle nut 46 and the wedge plate 42 connected to it are moved in direction Y of the imaginary coordinate system, and therefore the vertical slide 42 running on its wedge surface is transported in a third direction, e.g., in the direction of a double arrow Z (FIG. 1) related to the Z axis of the imaginary coordinate system. Limit switches, not shown, can serve to establish the end positions of the vertical slide 43 in direction Z.

According to FIG. 8, spring washers 52 are drawn onto each of the bolts 44 driven into the holding plate 41, and thrust against the vertical slide 43 and the heads of the bolts 44. These spring washers 52 resiliently press the vertical slide 43 against the wedge plate 42 thereby assuring a tight engagement of the confronting surfaces. A rotation of the motor 51 tending to remove the vertical slide 43 from the holding plate 41 will therefore result in a compression of the spring washers 52, and when the rotation of motor 51 is in the opposite sense the vertical slide 43 will be moved back toward the holding plate 41 by the force stored in the spring washers 52.

The vertical slide 43 serves as the bearer of a hammering mechanism 55 mounted on its underside, which bears a hammering tool 56 which can be reciprocated and is disposed above the circumferential surface of the drum 6, and which serves for sharpening the lands 22 of the punch 21.

As best seen in FIG. 10, an additional component, e.g., a casing 57, is rotatably mounted on the underside of the vertical slide 43, and its central axis 58 is preferably perpendicular to the circumferential surface of the drum 6. The upper end of the casing 57 is affixed to a cog wheel 59 which is connected by an endless cog belt 60 to an additional cog wheel 61 which is driven by an additional drive means and is fastened, for example, on the drive shaft of a reversible motor 62. The motor 62 is fastened on the vertical slide 43 which has, in a section prolonged beyond the wedge plate 42, a bore 63 (FIGS. 7 and 9) to accommodate the output shaft of motor 62. When the motor 62 is turned on, the casing 55 is rotated by the cog belt drive 59, 60, 61, in the direction of an arrow which refers to the coordinates in the imaginary coordinate system, i.e., rotations about the Z axis or about an axis parallel thereto. In the embodiment represented the axis of rotation is preferably the central axis 58 of the casing 57.

On the back of the casing 57 there is fastened a drive means in the form of an additional motor 64 whose shaft is rotatable in the direction of an arrow p (FIG. 10) and connected by a transmission means to the hammering tool 56 which is reciprocated parallel to the central axis 58 of the casing 57 when the motor 64 is turned on. Preferably the longitudinal axis of the hammering tool 56 lies precisely in the central axis 58.

On the front of the casing 57 there is mounted a holding bracket 65 which bears a height sensor 66 which has, for example, a mechanical feeler 67. The height sensor 66 serves to measure the height of the land 22 after it has been worked by the hammering tool 56, and to give an electrical signal accordingly.

The means for driving the hammering tool 56 consists according to FIG. 11, for example, of a crank drive which contains a shaft 72 journaled in bearings 71 in the casing 57 and which is connected to the shaft of the motor 64 and on whose front end a disk 73 is coaxially fastened. The latter has an excentrically disposed, projecting pin 74 which is rotatable in one end of a connecting rod 75. The other end of the connecting rod is pivotally mounted by means of a pin 76 between the two limbs of a U-shaped coupling member 77 whose web is fastened to one end of a reciprocating component, e.g., a rod 78. The latter is mounted with a sliding fit in two additional bearings 79 fastened in the casing 57 such that it can be reciprocated perpendicularly to the shaft 72. The reciprocating movement of the rod 78 is performed by means of the drive system formed on the motor 64, the drive shaft 72, the disk 73, the pin 74 and the connecting rod 75, the length of the reciprocating motion depending on the radial distance of pin 74 from the center of disk 73, and being constant.

As shown in FIGS. 11 to 13, the hammering tool is fastened pivotally on the free end of the rod 78 or mounted floatingly in any desired manner transversely of its reciprocating motion. It consists of a rectangular, plane-parallel piece which has at its upper end a U-shaped recess 80 which is formed by lateral walls with plane-parallel inside surfaces. Between the latter is disposed a projection 71 provided at the bottom of the rod 78 and having plane-parallel outside surfaces. A pivot pin 82 passes not only through bores 83 (FIG. 13) in the lateral walls of the socket 80 but also through a bore in the projection 81, so that a pivotal junction results whose pivoting axis is perpendicular to the plane-parallel inner surfaces. The thickness of the projection 81 and the distance between the lateral walls of the socket 80 is made to close tolerances such that the hammering tool 56 pivots substantially only parallel to the plane-parallel outer surfaces of the projection 81, but cannot to any appreciable extent be tilted or canted parallel to the pivot axis. Alternatively, the hammering tool 56 can be mounted on the rod 78 for sliding displacement, the direction of displacement being perpendicular to the pivot axis according to FIGS. 11 and 12 and perpendicular to the axis of the rod 78.

In accordance with FIGS. 11 to 14, a central and rear portion of the hammering tool 56 is inserted into a U-shaped groove 84 in a sliding piece 85 which in turn is displaceably guided in a groove 86 in a casing 87, the direction of displacement (arrow q in FIG. 11) being perpendicular to the axis of the rod 78 and perpendicular to the pivot axis. The front side of the hammering tool 56, however, is engaged by a thruster 88 which is disposed in an additional groove 89 in the casing 87 and is urged tightly by a compression spring 90 against the hammering tool 56. The hammering tool 56 is thus forced into the groove 84 and against slide 85 against the bottom of the groove 86, so that friction develops which has a braking effect on the hammering tool 56. The above-described guiding and braking system produces the result that the hammering tool 56 always remains in any tilted position once attained, without automatically returning to a neutral null position due to gravity or the like after a deflection.

The slide 85 is provided with a prolongation extending out of the casing 87, the end of which faces an interval sensor 91 which operates optically, inductively or capacitively, for example, or is in the form of a differential transformer. Alternatively, a prolongation extending out of the casing 87 can be provided at the other end of the slide with its end confronting a second interval sensor, the two interval sensors being connected to determine difference and emit electrical difference signals, which are characteristic of the distance d (FIG. 11) between the slide 85 and one or the other interval sensor.

The rocking movement of the hammering tool 56 is best limited on both sides by means not represented, so as to avoid excessively great deflections. The maximum double amplitude is indicated in FIG. 11 by the reference a.

The hammering tool 56 represented only diagrammatically in FIGS. 1 and 11 to 14 has, as seen in FIGS. 15 and 16, a roof-shaped notch 94 at its bottom end, with a V-shaped cross section. The open side of this notch 94 faces the periphery of the drum 6 after the hammering tool 56 is fastened to the rod 78. The notch 94 is formed by two lateral surfaces 95 meeting in a roof shape, which meet one another along a ridge line 96. The ridge line 96, as seen in FIG. 15, is straight in its middle part and perpendicular to a longitudinal axis of the hammering tool 56 running through it. At its extremities the ridge line, however, is preferably rounded slightly upward so as to prevent the formation of sharp impressions of its extremities in the lands 22. The special application of the hammering tool calls for such fine workmanship that the radius of curvature in the peak defining the ridge line 96 is as little as, say, two hundredths of a millimeter. By forming recesses 97 in the sections of the hammering tool 56 adjoining the notch 94, the notch 94 can be given any desired length between a very short length and a length corresponding to the thickness of the hammering tool 56. As seen in FIGS. 15 and 16 the lateral surfaces 95 are largely flat only in a wedge-shaped section 98 adjoining the straight portion of the ridge line, but they are rounded slightly outward in the adjacent sections 99 to prevent undesired impressions in the lands.

Otherwise, at least the lateral surfaces 95 consist of a sufficiently hard material, e.g., a hardened steel, a sintered material or a wear-resistant hard metal. The angle formed by the lateral surfaces 95 in the area of the ridge line 96 amounts, for example, to about 60 to 90°, but it depends largely on the circumstances of the individual case and is therefore to be determined experimentally. The height of the notch 94 (dimension h in FIG. 16) can amount to about 0.24 millimeters, while the length of the notch 94 (dimension l in FIG. 16) amounts to about 0.5 millimeters or less. At their bottom ends 100 (FIG. 15) the lateral surfaces 95 can also be slightly rounded.

In FIGS. 11 to 16 a hammering tool 56 is represented which is made in one piece. Alternatively, a multipartite, especially bipartite hammering tool can be provided, which is divided, for example, along its central plane 101 (FIG. 15), so that the ridge line 96 is formed by two abutting parts. Other divisions are also conceivable, for example in planes which enclose one of the two lateral surfaces 95. The individual pieces of the hammering tool are cemented, soldered, welded, clamped or otherwise joined together.

To enable the apparatus as described in conjunction with FIGS. 1 to 16 to be used for automatic production of a punch having a sharp cutting edge, it is necessary to provide motors 15, 37, 51 and 62 which will be capable of sufficiently precise control. Servo motors are suitable for this purpose, which are provided with tachogenerators, incremental transmitters for detecting position, and positioning means (indicated by the letters T and I in FIG. 1) and with the necessary control systems. Examples of such motors are brushless permanent magnet motors made by Indramat GmbH of D-8770 Lohr am Main or DC motors of the Sinumerik or Simatic series of Siemens AG of D-8000 Munich. Such motors are especially suited for use as numerical control positioning drives for constant start-stop operation, in which usually more than a thousand positionings can be performed per minute.

The apparatus described operates as follows:

First a flexible punch body 21 consisting of thin sheet metal is clamped with its back against the cylindrical periphery of the drum 6. The punch body 21 is already provided with the land 22 (or several lands). The upper surface 104 of the land is relatively broad and not suitable as a cutting edge. The edge 22 can be produced by etching, erosion, milling or the like.

Then the surface of the punch body 21 is sensed for the purpose of determining the track data on the available lands. An optical or any other type of sensing device 105 (FIG. 1) is used for this purpose, e.g., a camera with a CCD sensor (made by Thomson C S F of D-8000 Munich, or by Fairchild, U.S.A.), which is mounted on an arm 106 on the vertical slide 43. With the hammering tool 56 at rest the sensing device 105 is guided by motors 37, 15, 51 and 62, over the entire punch body 21, while sections of the lands are examined and entered in the memory of a data processing system. After this first rough sensing the data obtained are sorted and used for the control of the motors 15, 37, 51 and 62 in a second test run in which the sensing device 105 retravels the paths of the already roughly scanned edges 22. By means of the data obtained from the sensing device 105 the data previously obtained can be corrected by approximations or error reckoning such that they will define the center lines of the top surface 104 of each of the lands (FIG. 13). In a third and possibly additional test runs these data can be further corrected until finally very accurate and stored data are available on the position of the center line of the top surface 104 of the sensed lands 22.

The track data obtained through a "teach-in" process of this kind are then used for guiding the hammering tool 56 above and along the lands 22 and performing the hammering process. For this purpose the motors 15, 37, 51 and 62 are first operated such that the land is located at a preselected initial position within the notch 94 and between its lateral surfaces 95, which is indicated in FIG. 13 by the position of the broken outline of the hammering tool 56 which at this moment is still at its upper dead center position. On the basis of the already determined X and Y data, specification values $\psi$ are computed by means of which the $\psi$ motor 62 is controlled such that, when the tool is placed at the starting position, the notch 94 or ridge line 96 of the hammering tool 56 will be substantially parallel to the tangent of the actual track curve or center line of the top surface 104. The hammering process is then started by turning on motor 64 and thereby reciprocating the hammering tool 56 toward and away from the periphery of the drum 6, i.e., substantially perpendicularly to the top surface 104. The frequency of the reciprocating movement can amount to as much as several hundred Hertz. The hammering gradually converts the top surface 104, by means of the notch 94, to a sharp cutting edge 107 which in the area of the cutting edge assumes the form which the hammering tool 56 has in the area of the ridge line 96.

Simultaneously with the hammering process the motors 15, 32, 51 and 62 are operated with the aid of the stored data such that the land 22 is moved gradually along underneath the notch 94.

If the hammering tool 56 runs through a curve in the center line of the land surface 104, an appropriate operation especially of the $\psi$ motor will assure that the ridge line 96 will remain always largely tangent to the curve in question. The shorter the notch 94 is, i.e., the smaller the dimension l (FIG. 16) is, the longer can be the radii of the curved sections of the land.

Since the ridge line 96 of the hammering tool 56 should always be aligned as precisely as possible with the actual center of the land 22 or of the top surface 104 thereof, the stroke length of the hammering tool 56 will preferably be made shorter than the height h (FIG. 16) of the notch 94. This assures that the lateral surfaces 95 will always overhang the land 22 and thereby guide the hammering tool 56 laterally. This measure brings the advantage that a certain self-centering of the hammering tool 56 and of the notch 94 will take place if the track data determined by the sensing apparatus 105 do not agree precisely enough with the actual center line of the land surface 104. Since the hammering tool 56 is suspended floatingly on the rod 78, it can automatically align itself transversely of this center line. If the center line of the land surface 104 deviates slightly from the center plane of the undeflected hammering tool 56, as indicated diagrammatically in FIG. 13, from the stored track line, but will come to be located at a position that is better under the actual circumstances. For this reason any errors in the sensing of the lands or in the computation of the track data can be compensated afterwards. By means of the interval sensor 91 is is thus possible to monitor constantly the distance d (FIG. 11), which is a measure of the momentary angle of the hammering tool 56. The values determined for d are best fed to the data processing apparatus by which the track data are then continuously corrected such that the dimension Δ will always remain within an acceptable range. In the event of relatively great differences between the stored track curves and the actual center line of the land surface 104 this will prevent the hammering tool 56 from shifting to the degree that the dimension Δ becomes too great and causes the angle and the height of the sharp cutting edge 107 to depart too greatly from the desired values.

Figure 17:
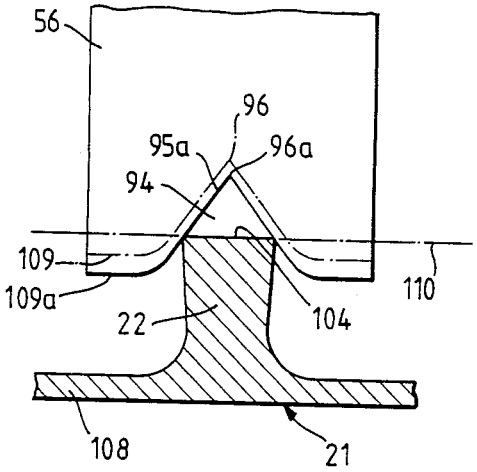
Figure 18:
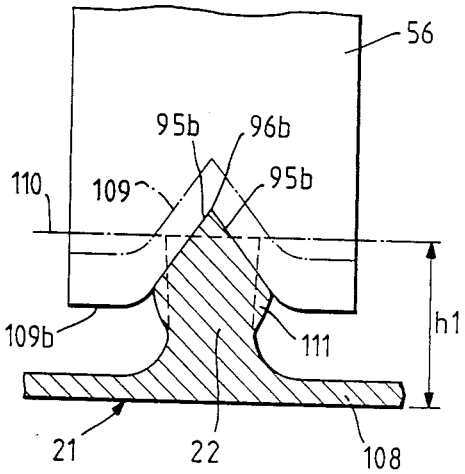
Figure 19:
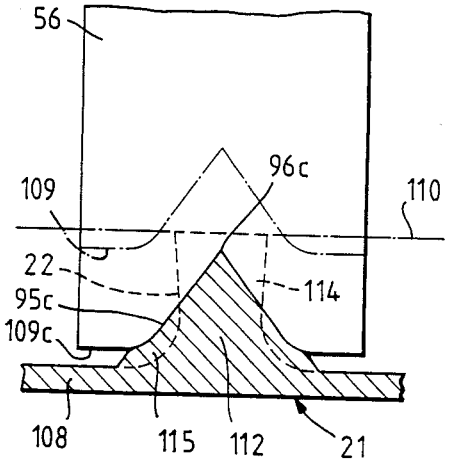
Figure 20:
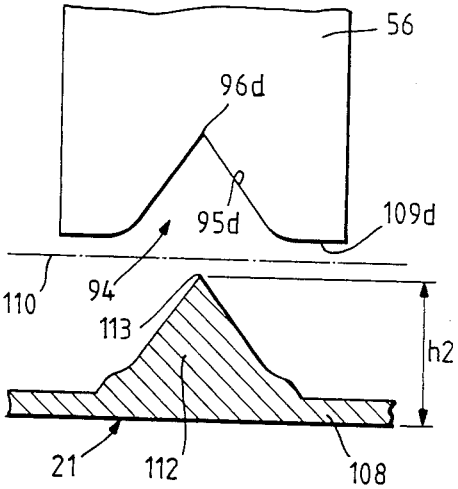

Details of the hammering process are represented greatly enlarged and diagrammatically in FIGS. 17 to 20. FIG. 17 shows a section of a punch body 21 in the form of a flexible plate originally 0.44 to 0.46 mm thick, for example, on whose surface the land 22 is formed, which prior to the etching process had been coated with a photoresist, has remained upstanding during the etching process, and therefore has the comparatively broad top surface 104. The sections of the punch body 21 that are adjacent to the land 22 have been removed by the etching process, so that the punch body 21 between the lands 22 consists now only of thin areas of sheet metal 102 of a thickness of, e.g., 0.12 mm. The hammering tool 56 is disposed above the land 22, and in its bottom edge the notch 94 is formed, whose height h (FIG. 16) amounts to about 0.2 to 0.25 mm, so that the hammering tool 56 cannot lay itself upon the uppermost surface of the plate 108. In FIGS. 17, 18 and 19 the bottom edge of the hammering tool 56 is represented by a broken line 109 which indicates the position which the bottom edge would assume at the top dead center of the hammering tool 56. On the other hand the solid lines 109*a* to 109*d* in FIG. 17 indicate the actual position of the bottom edge of the hammering tool 56. Accordingly, portions 95 and 96 in the different positions are additionally given the letters a to d. A line 110 defines the height h1 of the land 22 after the etching process, above flat bottom edge of the punch body 21. This height h1, considered over the length of the entire land 22, must be within tolerances of several hundredths of a millimeter, which is to be attributed to the usual tolerances in the production of sheet metal.

From FIG. 17 it can be seen that the hammering tool 56 has been lowered from its top dead center to such an extent that the lateral surfaces 95*a* of its notch 94 just contact the arrises of the land 22 so that no deformation has as yet occurred. It can also be seen that the top dead center (line 109) has been set so high that, when it is reached, the land 22 stands free and consequently the punch body 21 can be advanced, but the two lateral surfaces 95 still overhang both sides of the land 32, so that the latter cannot be moved sideways, i.e., to the right or left in FIG. 17, completely out of the notch 94. On account of the floating suspension of the hammering tool 56 transversely of the center line of the land surface 104, therefore, a self-centering action can always occur.

In the position according to FIG. 18 the hammering tool has been additionally lowered. The originally relatively wide land surface 104 has thus originally been cold-shaped partially or entirely into a sharp cutting edge, and also the upper sections of the lateral walls of the land 22 close to the cutting edge already lie closely against the contour of the hammering tool 56. Areas of forced out material 11 below the bottom edge 109*b* of the hammering tool 56 have formed on the lateral walls of the land 22.

FIG. 19 shows the reaching of the bottom dead center of the hammering tool 56 (line 109*c*). The bottom edge of the hammering tool 56 is opposite the upper surfaces of the plate bottom 108 at a slight distance therefrom, and the material contained in the original land 22 has flowed almost entirely into the notch 94. The original land 22 indicated in broken lines in FIG. 19 has been transformed into a cutting edge 112 with a virtually knife-sharp edge 113 (FIG. 20) whose height h2, measured from the bottom of the punch body 21 is slightly less than the height h1 of the original edge and amounts, for example, to about 0.43 mm. The layers of material 114 (FIG. 19) removed from the top of the land 22 have flowed wholly or partially into the bottom part or foot of the original land which has been slightly undercut by the etching process, so that the cutting edge has a substantially triangular profile corresponding to the roof-shaped notch 94. At the end of the sharpening of the entire land 22 the hammering tool 56 is moved by the Z motor 51 above the top dead center (FIG. 20), so that the punch body 21 can be removed from the drum 6 and then, after a possible treatment for hardening the cutting edge 112, can be used as a punch.

A special advantage of the method according to the invention is that the height h2 of the finished cutting edge depends along its entire length only on the distance between the bottom dead center (FIG. 19) and the periphery of the drum 6 on which the punch body 21 lies during the process, and therefore is a constant of the apparatus. Care must be taken only to see to it that the initial height h1 of the land 22 as established in the etching or the like is greater than the height h2 corresponding to the required height of the cutting edge 112 of the finished punch 21, i.e., very close tolerances do not have to be satisfied either in the production of the punch bodies 21 nor in the production of the land 22. Since the height h2 for the later punching process should be maintained very precisely constant over the entire length of the cutting edge 112, the bottom dead center is preferably established by means of a driving system in which the driving force is positively coupled to the hammering tool 56. The return to the top dead center position, however, can be produced by a negative coupling. The arrangement can optionally be made such that the cutting edge 112 is formed by a single hammering, or by performing two or more hammering operations, for example, by progressively lowering the bottom dead center of the hammering tool 56 in successively performed steps. Alternatively also the bottom dead center position can be established by means of a feedback system such as a piezoelectric or electromagnetic device, in which case as a rule several hammering operations are needed per section of land until its required height is reached.

The punch body 21 represented in FIG. 1 serves, after its lands 22 have been sharpened, or after the cutting edges 112 have been produced, for punching out approximately rectangular labels or the like, and has for this purpose a single, endless cutting edge. In the production of labels, however, it is common to punch simultaneously a plurality of labels situated side by side. FIG. 21 shows by way of example a backing strip 119 for self-adhesive label paper 120 from which twelve labels 121 are punched in a single punching operation. The gaps 122 represented between these labels 121 form a cohesive lattice which constitutes waste and which is pulled away from the backing strip 119 before the labels 121 are used. Each individual label 121 is cut by means of a continuous circumferential cutting edge 112 like the one represented in FIG. 20.

Instead of the sensing device 105 represented diagrammatically in FIG. 1 and consisting, for example, of a camera, any other desired method can be used for the purpose of determining the track data of the center line of the top surface 104 of the land. This will be explained below in conjunction with FIGS. 22 to 24 and a regulating and control system according to the invention represented in FIG. 25, which serves to control the drive means 15, 37, 51 and 62 such that the hammering tool 56 is automatically guided along the land 22 during the hammering.

First a designer develops the contours of the lands which the punch is to have, by means of a graphic CRT display and a data processing apparatus connected thereto, for example by means of a commercial CAD system. The shape of these contours corresponds to the course of the center lines of the land surfaces 104 to be made by etching. Pairs of coordinate values WXkn and WYkn correspond to the individual points on the contours in the Cartesian system of coordinates, wherein W is a set value, X and Y the X and Y coordinates, k the serial number of a contour which may be represented repeatedly on the display, and n the serial number of an individual point on one of these contours. The number n of points per contour can be as desired and depends mainly on the shape of the contours in the particular case.

After the contours are ready on the display, all pairs of coordinates are transferred in coded form to the mass storage of the data processing system. Then the stored data are used in controlling a plotter with a stylus or the light pen of a photoplotter, by means of which the tracks of the designed contours according to FIG. 22 are traced onto a film. The stored data correspond to a center line 128 of the exposed tracks 126. The negative obtained is then printed to obtain a positive film of the traces. This positive is then used as a mask for the purpose of exposing the surface of a punch body, e.g., a metal plate coated with a photoresistive material. The exposed surfaces of the photoresistive material are then washed away, so that only a photoresistive layer of a shape corresponding to the traces 126 remains on the punch body.

The punch body is then subjected to etching in which the exposed areas are etched away, so that, as shown in FIG. 17, a punch body remains which consists of the thin plate back 108 on which the lands 22 with their substantially planar surfaces 104 are left upstanding. Such etching techniques are generally known in the semiconductor art and are often used also in the production of punch bodies.

FIG. 23 shows a punch body 128 made in the manner described, which is to be used for the simultaneous punching of twenty labels corresponding to FIG. 21 and therefore has twenty lands 130 which are to be sharpened with the apparatus according to the invention. For controlling the apparatus according to the invention during this sharpening, the track data WXkn and WYkn obtained especially with the CAD system and stored in the memory of the computer can be used directly as long as it can be assumed that the lands 130 correspond to the traces 126 with a high degree of accuracy. This assumption is but rarely fulfilled in practice. On account of the expansion of the film masks due to temperature effects in the time between the exposure and the etching process, due to corresponding elongations of the punch body in the time between the etching process and the hammering process or the like, considerable dimensional variations can result, the result of which would be that the hammering tool 56 would be guided by the stored data on paths which would deviate from the center lines of the lands 130 so greatly that they could not be compensated by the floating suspension of the hammering tool 56 alone. From the track data WXkn and WYkn, it is furthermore possible to establish, by means of the computer, the set values Wψkn which establish the angular position of the hammering tool 56 corresponding to the tangents at the points defined by the values WXkn and WYkn. The required value WZkn of the height of the lands, which as a rule is identical for all points, can be entered manually into the memory of the computer according to the individual case.

For the correction of the stored data it would be possible to multiply them by a correction factor computed from the distance between registration marks 131 which are placed in the four corners both of the design and of the etched punch body 129. If the distance between the specified locations of the registration marks of the design in directions X and Y is indicated as WXm and WYm, respectively, but the actual distances between the registration marks 131 of the punch body are designated by Xm and Ym, the correction factors Kx and Ky in directions X and Y respectively by WXm and WYm, and the manually or automatically determined actual distance between the registration marks 131 on the punch body as Xm and Ym, it follows that the correction factors Kx and Ky, in directions X and Y, respectively, will be $Kx=EXm/Xm$ and $Ky=WYm/Ym$. After the stored values have been corrected with these correction factors, corrected coordinate factors are thus obtained in the memory of the computer which are derived from the equations $WX'kn=Kx\cdot WXkn$ and $WY'kn=Ky\cdot WYkn$, and which give the corrected values to be specified for the coordinates on which the apparatus according to FIG. 1 is actually to be controlled. From these values, corrected $W\psi'kn$ values are also obtained if they are needed. If despite this correction additional small differences occur in the directions X or Y, e.g., on account of mechanical inaccuracies in the apparatus, they can be equalized by means of the floating mounting of the hammering tool 56. One of the four registration marks 131, e.g., those in the bottom left corner of FIG. 23, preferably serves as the zero point of the Cartesian coordinate system.

In addition, or alternatively, it can be desirable to perform further correction. As FIG. 23 shows, the hammering tool 56, after hammering the first land 130 ($k=1$) of the punch 129, has to be lifted off from this edge and set at a defined initial position ($n=0$) on the next land ($k=2$). In the example given, a total of twenty such initial positions, X10, Y10, to X200, Y200, must be accessed. If the hammering tool 56 remains in a skewed position that it reached in the working of the previously sharpened land, then, on account of the guiding and braking system described in conjunction with FIGS. 11 and 12, when the new initial position is accessed, there will be an error corresponding to the present skew. To prevent this error the hammering tool 56 might be provided, contrary to FIGS. 11 and 12, with a restoring system in the form of a spring, a magnet or the like, which will automatically restore the hammering tool to a defined zero position after being raised from a land, so that in this zero position it can be adjusted to the initial position on the next land on the basis of the stored data WX'kn and WY'kn. Since such restoring systems do not operate in a sufficiently perfect manner, the hammering tool 56 is provided on the one hand with the guiding and braking system described in connection with FIGS. 11 and 12, which assures that, when raised from an land, the hammering tool 56 will remain in the position in which it happens then to be. On the other hand, the error due to this position, which is determined by the interval sensor 91, will be allowed for when the next initial position is approached, by a correspondingly corrected operation of the X motor and Y motor 37 and 15, respectively. For even if at the next initial position the land might still enter into the notch 94 and thus might produce another self-centering of the hammering tool 56, a gradually increasing skew of the hammering tool 56 might result on the basis of the sum of errors or the like, which upon a later approach to any other initial position might cause the notch 94 to become situated out of the range of the corresponding land. It would then be impossible to work this edge.

What appears to be best, however, is an operation of the motors 15 and 37 such that the hammering tool 56 always assumes an essentially unskewed position. Such an operation will now be explained with the aid of FIGS. 24 and 25. In FIG. 24 a line 132 indicates the actual state of a curved section of any land 130 of FIG. 23. The hammering tool 56 is situated in a skewed position corresponding to a point 133 of this land, which has the actual coordinates Xkn and Ykn. Since the hammering tool 56 is always so aligned that its ridge line 96 is substantially tangent to the center line 128 in memory, it is skewed to an angle $\psi$ from its normal position. On the other hand, the hammering mechanism 55 and its axis 58 is under the control of the motors 15, 37 at a point 134 which lies on a broken line 135 which corresponds to the track curve in memory for this land. This point has the actual coordinates X'kn and Y'kn, and it can here be assumed that these will be identical after the controlling action to the corresponding stored set values WX'kn and WY'kn. It follows from FIG. 24 that the skew of the hammering tool 56 and of its ridge line 96 with respect to the hammering mechanism 55 and its axis 58 momentarily corresponds to the value E which has an X component $Ex=E\cdot\cos\psi$ and a Y component $EY=E\cdot\sin\psi$. If the hammering tool 56 should be returned to an essentially unskewed position, the values X'kn and Y'kn would therefore have to be corrected by the amounts Ex and Ey in order thereby to transfer the hammering mechanism 55 to a position with the coordinates X''kn and Y''kn and thus to return the hammering tool 56 laterally guided by the land 130 to its unskewed position. This can also be accomplished by continually informing the computer of the values of E determined by the interval sensor and converting the set values WX'kn and WY'kn continually to new set values $WX''kn=EX'kn+Ex$, and $WY''kn=WY'kn+Ey$. The angle $\psi$ needed for the formation of the values of cos $\psi$ and sin $\psi$ is computed from the incremental values supplied by the $\psi$ motor 62. This assures that the hammering tool 56 will be virtually unskewed upon rising from a land and can be set by means of the stored values WX'ko and WY'ko reliably to the initial position on the next land.

Such computations can be eliminated if the preferred controlling apparatus according to FIG. 25 is used in which th circuitry needed for the control of the apparatus according to FIG. 1 is represented diagrammatically and in which the same reference numbers as in FIGS. 1 to 16 are used insofar as possible. To simplify the drawing, provision has been made for driving the vertical slide 43 as well as the horizontal slide 28 with a threaded spindle 136. The entire hammering mechanism which can be moved as a whole in direction Z is surrounded by a broken line. Furthermore, the incremental transmitters are represented individually and marked with the letters X', Y', Z', and $\psi'$ in accordance with the actual values transmitted by them. A broken line 137 identifies the pivot axis of the hammering tool 56. Lastly, two interval sensors 91*a* and 91*b* are provided, which are connected as differential transformers and consist, for example, of interval sensors of type MHV of Schaevitz Engineering in Camden, N.Y. (USA). Alternatively, field plate differential sensors FP 210 D 250 of Siemens AG in Munich or dynamometers or the like could be provided, which would emit signals proportional to the deflection of the slide 85.

The control and regulating system according to FIG. 25, whose components are normally integrated partially into the motors 15, 37, 51 and 62, and partially into the data processing system, contains a control computer 140 with a data input 141 to which data from the memory of the data processing apparatus are fed, and four outputs X, Y, Z and $\psi$ to which the set values WX'kn, WY;kn, WZ'kn and W$\psi$'kn are delivered. The values EX'kn and WY'kn have the same meaning as above, while WZ'kn is a set value, corrected in some cases, for direction Z, and is important for the height of the finished land 22, and W$\psi$'kn identifies the set value determined by the WX'kn and WY'kn coordinates for the angle of rotation of the hammering tool 56.

At its incremental output the X motor 37 puts out signals which are characteristic of the actual coordinates of the hammering mechanism 55 and axis 58 in direction X. The incremental transmitter is connected to an adder circuit 142 which is connected by a controller 143 and an amplifier 144 to a control input of the motor 37. Another input of the adder circuit 142 is connected to the X output of the control computer 140, while a third input is connected to the output of a multiplier circuit 145. The latter has two inputs, one of which is connected to the output of a differential amplifier 146 while the other is connected to the output 147 of a converter 148. The input of the converter 148 is connected to the output of the incremental transmitter of the $\psi$ motor 62. The converter 148 serves to convert the momentary $\psi'$ values to cos $\psi$ values delivered to the output 147 and to sin $\psi$ values delivered to an additional output 149. The two inputs of the differential amplifier 146 are connected to the outputs of the interval sensors 91*a* and 91*b*.

The control apparatus described operates as follows:

As long as the hammering tool 56 remains unskewed, the differential amplifier 146 and therefore also the multiplier circuit 145 puts out a signal corresponding to the value 0. Consequently the adding circuit 142 adds the actual values X' and the set values WX'kn truly, i.e., with the correct sign. A signal corresponding to the total is converted by the controller 143 to a signal which, after amplification in the amplifier 144, operates the motor 37 such that any differences between the value X'kn and the value WX'kn are changed to zero. The hammering mechanism 55 therefore always assumes its desired position.

If the land 22 differs in direction X from the stored WX'kn values, this will result in a skewing of the hammering tool 56 about the axis 137 and in a signal corresponding to the deflection E at the output of the differential amplifier 146. This signal is multiplied in the multiplier circuit 145 by the cos $\psi$ value of the momentary $\psi'$ value and is also fed truly to the adder circuit 142. Therefore, a signal $Xd = WX'kn + X' + Ex$ is delivered to the controller 143 so that according to the feed-back $Xd \rightarrow 0$ is reached after the controlling action. This means the same thing as a correction of the corresponding WX'kn value such that the hammering mechanism 55 is adjusted not to position WX'kn but to a position which is greater or smaller by Ex in order thus to rotate the hammering tool 56 back to its unskewed position corresponding to $Ex = 0$.

The Y motor 15 is operated in the same manner for the drum 6. In this case the Y output of the controlling computer 140 is connected by an adding circuit 150, a controller 151 and an amplifier 152 to the control input of the motor 15. An additional input of the adding circuit 150 is connected to the incremental transmitter of the motor 15. The output of the differential amplifier 146 is connected to an input of a multiplier circuit 153 whose other input is connected to the output 149 of the converter 148 and whose output is connected with an additional input of the adding circuit 150. In this manner, in the correction of the WY'kn values, the measured difference E is multiplied by sin $\psi$.

An additional control circuit is provided for the Z motor 51 in that the Wz'kn signals appearing at the Z output of the control computer 140 are fed to its control input through an adding circuit 154, a controller 155 and an amplifier 156. Another input of the adding circuit 154 is connected to the incremental output of the Z motor 51. In this manner departures of the Z' values from the WZ'kn values are compensated. In addition, the height sensor 66 (FIG. 1) with its pickup 67, which is for example a mechanical probe lying on the sharpened rim 22 close behind the hammering tool 56, or else a interval sensor of some other type, is associated with this circuit. The height sensor 66 fastened to the hammering mechanism 55 has the purpose, for example, of compensating any departures of the peripheral surface of the drum 6 from its ideal form (out-of-roundness, parallelism deficiencies or the like). For this purpose the procedure is as follows:

At the beginning of the hammering process the hammering tool 56 is not brought to its set value WZ'kn immediately but gradually, so as to avoid disturbances in the section of the land 22 adjacent the initial position of the hammering process, while the land 22 is being already carried past the hammering tool 56 in the X and/or Y direction and is being sharpened. At this moment the height sensor 66 is still inactivated. The activation of the height sensor 66 takes place when the set value WZ'kn is reached. For this purpose the analog output signal of the height sensor 66 is delivered, for example, as indicated diagrammatically in FIG. 25, through a release circuit or a switch 157 of an adding circuit 158 whose output is connected to the Z output of the control computer 140 and which has an additional input to which the WZ'kn signals are delivered. When the hammering tool 56 reaches the value WZ'kn, a switching signal is delivered to an additional input of the switch 157, so that after this point in time the output signals of the height sensor 66 are allowed to pass through to the adding circuit 158. Furthermore, the output signal of the height sensor 66 that is present at this time is best defined as the correction signal $Ez = 0$. As a result, all signals appearing at a later point in time and differing from the signal $Ez = 0$ produce through the adding circuit 158 such a correction of the set values Wz'kn that errors due to any jumping of the drum 6 or the like will be compensated. The finished punch 21 therefore will have a cutting edge of constant height. Since the probe 67 is preferably disposed behind the hammering tool 56, the closing of the switch 157 should take place with a certain time delay in comparison to the first time the set value was reached in the direction Z, in order thereby to assure that the probe 67 lies on a section of the rim that has the set height.

Lastly, the maintenance of the value W$\psi$'kn is also monitored since the $\psi$ output of the control computer 140 is fed through an adding circuit 160, a controller 161 and an amplifier 162 to the control input of the $\psi$ motor 62 and an additional input of the adding circuit 160 is connected to the output of the incremental transmitter of the $\psi$ motor 62.

The invention is not limited to the embodiments described, which can be modified in many ways. Only by way of example the following possibilities of modification are pointed out. Instead of the bores 16, other fastening means, e.g., mechanical clamping and clip strips can be provided on the drum 6 for fastening the punch body 21. It is furthermore possible to provide, instead of the drum 6, a flat table which can be shifted back and forth in direction Y for the punch body. Instead of the described sensing device 105 other systems can be provided for determining the set values for the track lines of the lands. These data might also be determined, for example, outside of the apparatus of FIG. 1 with means other than those represented, e.g., by sensing methods known in themselves. At the same time a manual travel of the lands with suitable systems as a teach-in method is conceivable. Instead of the crank or cam drive for the hammering tool 56, other drives can be provided. The same applies to the movements in the directions X, Y, Z and $\psi$. The dimensions and other parameters given in the description serve only as examples which might pertain to a practical embodiment. The dimensions and parameters to be selected will otherwise depend to a great extent on the nature and size of the objects to be punched.

It can furthermore happen that the punch bodies will have lands having crossing or sharply branching parts. In the sharpening of such edges the hammering tool is to be lifted up from the punch body in the area of the crossings and the fine work on the crossings and branches is to be performed manually as formerly, e.g., with scrapers, engraving burins or the like. In the working of lands which, in contrast to the lands 22 (FIG. 1) or 130 (FIG. 23) are not endless but run along open paths, e.g., simple straight lines, the procedure can be as described above. Instead of punch bodies of hardened material, e.g., steel, punch bodies of comparatively soft materials can be used, which are hardened after the hammering. Instead of the registration marks 131 other points on the punch body can be utilized for the determination of correction values. Furthermore, it is not necessary that the Z axis be vertical and the Y axis horizontal, since other arrangements can also be selected.

The lands to be worked with the apparatus according to FIG. 1 can furthermore be produced in a first process step by a method other than etching. Lastly, only those features essential to an understanding of the invention have been dealt with in the description and the drawings, so that the use of other auxiliary systems, especially for the setting up, adjustment and calibration of the apparatus, is entirely subject to the skilled practitioner's preference.

A modification of the method described can furthermore consist in combining the hammering process according to FIGS. 26 to 29 with a cutting or scraping process. For this purpose a tool 170 is provided whose front surface facing in the direction of the feed (arrow r) merges along a sharp cutting edge 171 (FIG. 27) with a V-shaped notch 172. As it will appear from a comparison of FIGS. 15 and 16 on the one hand and FIGS. 26 and 27 on the other, the tools 56 and 170 are otherwise of substantially identical configuration. This is evident in the fact that the tool 170 also has in the rear area a rounded transition edge 173 which is indicated in broken lines in FIG. 26 and begins approximate at line 174 but is lacking on the front side. The lateral surfaces 175 serving for the hammering, which define the V-shaped notch 172, are again largely planar.

FIGS. 28 and 29 show the sharpening of a punch body 176 with a land 177 by the tool 170. By the appropriate controlling of the Z motor 51 (FIG. 25) the tool 170 is not immediately placed at its set height at the beginning of the hammering. Instead, during its advancement (arrow r) and its oscillation (arrow s) it is first lowered within an introductory section 178 (FIG. 28) onto the land 177, so that its height 177*a* remains unchanged on an initial portion 179 of the introductory section 178. Not until its final section 180 is the land 117 brought by further lowering of the tool to its set height which is lower by the dimension marked 181 in FIG. 28 than the original height 177*a* and is maintained as the sharpening continues (section 182 FIGS. 28 and 29).

During the lowering of the tool 170, the land is sharpened both by hammering and by cutting or scraping as the sharp cutting edge 171 on the front side of the tool 170 removes chips 183 on both sides of the land 177 (FIGS. 28 and 29). This process continues over the entire length of the land 177, while the tool 170 performs the advancing and oscillating movement indicated in FIG. 28 by a wavy line 184. The remaining lateral surfaces 185 formed by combined hammering and cutting or scraping are represented in FIG. 29 where the direction of movement of the tool 170, not shown, is indicated by the arrow r, the tool being considered to be momentarily in a position just in front of the point of transition 186 between an already sharpened and a still-unsharpened portion of the land 177.

The combined sharpening of the land 177 by hammering and cutting or scraping can lastly be replaced by sharpening characterized by cutting or scraping alone. For this it is necessary only to shut off the oscillatory movement of the tool 170 produced by the motor 64 (FIGS. 1 and 25) and to move the tool only in the direction of the arrow r. The set height of the tool 170 can likewise be gradually reached in the area of the section 178. Aside from that it is possible in a combined hammering and cutting or scraping process to adjust the amplitude of the oscillating movement (arrow s) to any desirable value.

We claim:

1. An apparatus for automatically producing a punch which has a sharp cutting edge and which consists of a punch body provided with an upstanding land, especially for use in label cutting apparatus for paper, metal foils or plastic films, textiles, flexible printed circuits, labels or the like; said apparatus comprising a table for the punch body, a hammering and/or cutting tool with a roof-shaped notch facing the table, a first drive means for automatically moving back and forth the tool in the direction of the table, and additional drive means for producing relative movements between the table and the tool by means of which the tool can be guided automatically along the land.

2. An apparatus according to claim 1, wherein the table is in the form of a drum rotatable in a first direction and said additional drive means is a second drive means for rotating the drum in the first direction.

3. An apparatus according to claim 1, wherein the first drive means has a first component which is movable back and forth and on which the tool is mounted floatingly transversely to the direction of the back-and-forth movement.

4. An apparatus according to claim 3, wherein the tool is mounted pivotingly on the first component.

5. An apparatus according to claim 1, wherein the tool is mounted rotatably about an axis parallel to the direction of the back-and-forth movement, and said additional drive means comprises a third drive means for rotating the tool about the axis.

6. An apparatus according to claim 5, wherein the first drive means is mounted on a second component which is mounted rotatably on a third component which is movable in a second direction, and wherein said additional drive means comprises a fourth drive means for moving the third component in the second direction.

7. An apparatus according to claim 6, wherein the third component is mounted on a fourth component which is movable in a third direction, and wherein said additional drive means comprises a fifth drive means for moving the fourth component in the third direction.

8. An apparatus according to claim 7, comprising at least one distance sensor associated with the tool.

9. An apparatus according to claim 3, 4 or 8, comprising a guiding and braking means associated with the tool.

10. An apparatus according to claim 3, 4 or 8, wherein the first drive means has a stroke selected such that the tool constantly overlaps the land between two dead centers and is laterally guided thereby.

11. An apparatus according to claim 2, wherein the second drive means has a reversible, controllable motor.

12. An apparatus according to claim 5, wherein the second and third drive means have each a reversible, controllable motor.

13. An apparatus according to claim 7, wherein the second, third, fourth and fifth drive means have each a reversible, controllable motor.

14. An apparatus according to claim 5, wherein the third drive means is controlled such that the notch of the tool is aligned substantially in the direction of the tangent to the land.

15. An apparatus according to claim 8, wherein the at least one distance sensor is connected to a control means connected to the second and fifth drive means, the control means controlling the second and fifth drive means such that position changes of the tool from a normal position thereof caused by the floating mount of the tool are compensated.

16. An apparatus according to claim 6, comprising a sensor connected with the second component, which has another sensor following the tool for measuring the height of the land.

17. An apparatus according to claim 16, wherein the other sensor is connected to a control means connected to the fourth drive means, the control means controlling the fourth drive means such that differences in the height of the land measured by the other sensor are compensated.

18. An apparatus according to claim 1, wherein the tool is a combined hammering and cutting or scraping tool.

19. An apparatus according to claim 1, wherein the tool is a cutting or scrapping tool.

20. An apparatus according to claim 1, wherein the tool is a hammering tool.

* * * * *